United States Patent [19]

Bucher

[11] 4,393,639

[45] Jul. 19, 1983

[54] REINFORCING ELEMENT AND PROCESS FOR ITS MANUFACTURE

[76] Inventor: Franz Bucher, Reut-Nicolussi-Str. 12, A-6020 Innsbruck, Austria

[21] Appl. No.: 212,718

[22] PCT Filed: Jan. 29, 1980

[86] PCT No.: PCT/AT80/00003

§ 371 Date: Oct. 27, 1980

§ 102(e) Date: Oct. 24, 1980

[87] PCT Pub. No.: WO80/01818

PCT Pub. Date: Sep. 4, 1980

[30] Foreign Application Priority Data

Feb. 27, 1979 [AT] Austria ..... 1484/79

[51] Int. Cl.[3] ..... E04C 5/02

[52] U.S. Cl. ..... 52/730; 52/653; 52/693

[58] Field of Search ..... 52/653, 693, 730

[56] References Cited

U.S. PATENT DOCUMENTS

| | | | |
|---|---|---|---|
| 954,128 | 4/1910 | McLaughlin . | |
| 3,345,793 | 10/1967 | Cvikl | 52/693 X |
| 3,831,890 | 8/1974 | Tolliver | 52/653 X |

FOREIGN PATENT DOCUMENTS

| | | |
|---|---|---|
| 230074 | 3/1963 | Austria . |
| 309757 | 12/1972 | Austria . |
| 310397 | 1/1973 | Austria . |
| 907587 | 2/1954 | Fed. Rep. of Germany . |
| 1609910 | 1/1970 | Fed. Rep. of Germany . |
| 2268916 | 11/1975 | France . |
| 67478 | 10/1950 | Netherlands . |
| 234024 | 12/1944 | Switzerland . |
| 15946 | 11/1908 | United Kingdom . |

*Primary Examiner*—J. Karl Bell

*Attorney, Agent, or Firm*—Karl F. Ross

[57] ABSTRACT

A reinforcing insert for a tension zone of a ferroconcrete member comprises two or more closely juxtaposed, parallel rods of different lengths and with staggered extremities, each shorter rod being connected at least at its ends to an adjoining longer rod by elongate weld joints of sufficient strength to transfer its tensile stress to that longer rod. The weld joints may be formed by transversely inserting a fusible wire between two reinforcing rods and pressing the latter together with the aid of two electrodes between which a heating current is being passed. Laterally projecting parts of that wire, left in place after the welding operation, may serve as anchor studs and/or as spacers establishing the requisite separation from associated falsework.

11 Claims, 11 Drawing Figures

REINFORCING ELEMENT AND PROCESS FOR ITS MANUFACTURE

FIELD OF THE INVENTION

My present invention relates to a reinforcing element for strengthening the tension zone of flexurally stressed structural member of ferroconcrete in which that element is inserted, with at least two parallel reinforcing rods whose lengths and dispositions are chosen to provide an assembly of tensile strength diminishing toward its extremities in approximate conformity with the moment line.

BACKGROUND OF THE INVENTION

The present state of the ferroconcrete art assumes, in the classical dimensioning theory for flexurally stressed structural members, an interrelationship between tensile and compressive forces by way of the shear strength of the concrete. This assumption presupposes that the reinforcement steel sustaining the tensile forces in the tension zone of the flexurally stressed structural member has bonding adhesiveness. Only when this adhesiveness is assured does the reinforcement steel transfer its forces to the surrounding concrete which retransmits them via its shear capacity to the compression zone of the concrete.

The bonding ability of the reinforcing rod under tension in the concrete is a significant, cost-intensive weak point whose at least partial solution has been tried by a twisting of the rods (British Pat. No. 15,946/1908), profiling, rolling, convolutions, welded ladder-type inserts (German Pat. No. 907,587), welded-on junction pieces, upsetting, superposed sleeves (German laid-open specification No. 1,609,910) etc. In this way it has actually been possible to reduce the bonding length.

My Austrian Pat. No. 310,397 shows another possibility according to which short anchor ties are welded at least onto the ends of the reinforcing rods. Even though in this manner the bonding lengths of the reinforcing rods can be completely omitted and high-grade reinforcement steel can thereby be saved, since the short reinforcements can be produced from lower-quality steel, there still remains the need for manufacturing these short reinforcements and welding them on.

Finally, Austrian Pat. No. 309,757 deals with a shortening of the bonding length and proposes for this purpose, in the case of reinforcing mats, to dispose transverse rods within that half of the bonding length which lies at the end of the longitudinal rods.

OBJECTS OF THE INVENTION

My present invention has for its object to provide a reinforcing element of the kind initially referred to wherein any supplemental bonding means between parallel rods can be dispensed with and thus further economy can be achieved.

A more particular object of my invention is to provide, for this purpose, means for transferring the tensile force of each shorter reinforcing rod to the next-longer one in such a manner that at the end point of each reinforcing rod the tensile force is reduced to zero.

SUMMARY OF THE INVENTION

According to the invention this problem is solved in that each shorter reinforcing rod, in a bundle of closely juxtaposed rods with relatively staggered extremities, directly contacts at least one longer reinforcing rod, in a manner known per se, over its entire length and is connected with it along several stretches in a force-transferring way, preferably by welding. The ends of each shorter rod, offset from the extremities of an adjoining longer rod, are connected to the latter by such stretches.

Thus, the reinforcing element according to the invention significantly differs from all known reinforcing elements, such as beams, mats etc., in which the additional reinforcing rods required for absorption of the moment are disposed with the prescribed minimum spacing from the longitudinal reinforcing rods and are welded to the stirrups or transverse rods which may be disposed one below the other, again only with a relative minimum spacing. Hence, the connection between longitudinal and additional rods in these conventional assemblies is limited—from a geometrical viewpoint—to the welding points at the transverse rods, whose tensile strength is of course too low for a transmission of the arising forces.

According to an important feature of my invention, the overall cross-sectional area of the connecting stretches between any two reinforcing rods has a magnitude at least sufficient for a complete force transfer from the shorter reinforcing rod which is to be relieved of stresses. Thus, the overall cross-sectional area of the connections required for the complete force transfer from the reinforcing rods to be relieved of stresses is larger than with the aforementioned point connections between longitudinal and transverse rods where, furthermore, the path of the force stream is lengthened via transverse rods so that non-negligible moment stresses from eccentric tensile-force action must be taken into consideration.

I prefer, therefore, that each connection between the reinforcing rods is an elongate weld joint of sufficient strength to transfer the entire tensile stresses on both sides of the region of maximum bending moment from the shorter to the longer reinforcing rod or rods.

With the reinforcing element according to the invention it becomes possible, on account of the direct contact of the reinforcing rods, to realize connections which are at least equivalent to the tensile force to be introduced, inasmuch as the length and number of the connecting stretches can be freely selected.

True enough, it is already known to replace reinforcing rods by bundles of at least three thinner reinforcing rods of identical length (Austrian Pat. No. 230,074), with the rods of the bundle in mutual contact and a connection also provided at individual locations or over the entire length. The subdivision of the individual rod into welded bundles of equally long rods entails various advantages: Surface enlargement, increase in buckling strength, more favorable moment of inertia and section modulus, limitation to a few diameters, as well as—with replacement of large-diameter rods—lower purchase prices since the latter entail considerable price increases relative to rods in the medium-diameter range. The last mentioned advantage is particularly marked with reinforcing rods of high-grade steel.

The teaching of bundling known from Austrian Pat. No. 230,074, however, cannot be directly transferred to the problem of bonding-length shortening since, as mentioned, the transfer of the force stream imposes upon the connection certain criteria which cannot be ascertained from that Austrian patent inasmuch as the considerations pertaining thereto have not been taken into account. Its teaching is therefore limited to the bundling of three or more rods of equal length whose connection essentially has only the purpose of holding them together.

With the reinforcing element according to my present invention there is achieved a flowing tying-in of the force stream into the retransmitting reinforcing rod, with reduction of the transverse component to its minimum, namely the sum of the radii of the two reinforcing rods, and thus also a minimization of the moment stresses due to the eccentric tensile-force action.

It is also essential that, in a reinforcing element consisting of more than two reinforcing rods, the cross-sectional areas of the connections between an intermediate-length reinforcing rod—that is already connected to at least one shorter reinforcing rod and a longer reinforcing rod must be greater than in a two-rod reinforcing element. In this case it is necessary to transfer not only the force from the intermediate-length reinforcing rod but also the force already absorbed by the shorter reinforcing rod or rods, which means that the capacity of the connections to absorb tensile forces must depend on the overall cross-sectional area of these shorter reinforcing rods. A simple force transfer occurs only with multi-rod reinforcing elements and in that case only in the end regions of an intermediate-length reinforcing rod. Another feature of my invention, therefore, provides that the overall cross-sectional area of the connections between any two reinforcing elements be proportional to the cross-sectional area to be relieved of stresses.

Since the extent of the tensile-force transfer increases from the point of maximum moment toward the two ends of the reinforcing rod, a further feature of my invention may provide that either the distance between two connecting stretches of like length be made smaller in the end region or, with equal distance, the lengths thereof and thus their tension-absorbing capacity be increased.

For manufacturing reasons, however, an alternation between identically long connecting stretches and identically long stretches of mere contact between the rods is preferred, this resulting in connecting stretches with cross-sectional areas which progressively surpass the minimum requirements from the end regions to the point of maximum moment. The connections, as mentioned, are preferably made by welding. In such a case each joint may comprise at least one weld bead hardened after being melted from a wire, whose diameter is less than that of the rods, introduced in a manner known per se between the reinforcing rods before the resistance welding. The number of weld beads and thus of the introduced wires depends on the extent of the desired force transfer. If the connection by means of one weld bead is not sufficient, two or more weld beads can be provided in a row in the longitudinal direction of the reinforcing element, each of which is melted from a fusible wire and hardened.

For making each connection, a total of three rods as seen in the direction of current flow—the two reinforcing rods and the interposed wire—are welded together with only point contact between any two of them; the extremely high current density in the middle wire, resulting therefrom and from its small diameter, causes a complete fusion thereof into a weld bead. According to the diameter of the two reinforcing rods they are, at most, slightly softened in the adjacent region during the welding process and the weld bead flows out in the two gorges which extend along the line of contact of the two reinforcing rods. The possible limited melting of the reinforcing rods themselves has also at most a slight influence upon the properties of the reinforcement steel so that high-grade steels, whose welding in structural-steel mats has always been beset by problems, can be primarily processed.

Thereby it is possible to produce also reinforcing elements wherein one or more of the introduced fusible wires project at least unilaterally beyond the reinforcing rods. This is accomplished in that the wire is inserted between the reinforcing rods to an extent exceeding the amount required for the production of the weld joint, e.g. in accordance with the desired spacing of the reinforcing elements from associated falsework. If the reinforcing rods have different diameters, the diameter of the inserted wires advantageously amounts to 0.2 to 0.9 times the diameter of the thinnest reinforcing rod, preferably 0.4 to 0.5 times that. If the wire is allowed to project unilaterally, it may act as a spacer for such falsework. If the wire is allowed to project bilaterally, the projecting parts can be used to improve the anchoring in the concrete.

A process for the production of such a reinforcing insert, wherein two reinforcing rods are passed with mutual spacing between two confronting welding electrodes and wherein at least one fusible wire is inserted between the reinforcing rods and the welding is thereupon performed, with each wire melting into a weld bead and with the two reinforcing rods being moved toward each other by the contact pressure of the electrodes and being fixed in mutual contact by the hardening weld bead or beads, can be utilized with particular advantage in automatic manufacturing plants with periodic advance such as those heretofore used for the production of mats or lattice girders. In this case each wire forming a weld bead is drawn off a reel and is discontinuously inserted between the reinforcing rods at right angles thereto, each hardening weld bead being broken off the arriving wire by the advance immediately after the welding process if the wire projects at most unilaterally beyond the reinforcing rods. If the wire is to project bilaterally, it is severed before the start of the advancing step. Especially for the use of the projecting wire as a spacer it is contemplated to have the wire made of a noncorroding material in order to avoid an aftertreatment.

The reinforcing element according to the invention is utilizable not only as an individual insert but also as part of a reinforcement configuration. This offers the possibility, for example, of producing reinforcing mats wherein the length of the additional, shorter transverse rods no longer need depend on the mesh width, in view of the requirement for a welding joint at the ends, but can be actually adapted to the moment line.

BRIEF DESCRIPTION OF THE DRAWING

The above and other features of my invention will be described hereinafter with reference to the accompanying drawing in which.

SPECIFIC DESCRIPTION

Figure 1:
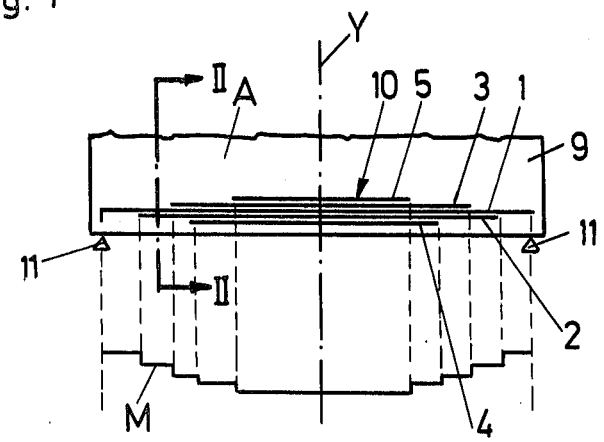
FIG. 1 shows a flexurally stressed ferroconcrete structural member, resting on two end supports, with a schematically indicated reinforcing element according to the invention and with an approximate representation of the moment line.

A ferroconcrete structural member 9 according to FIG. 1, carried by supports 11, comprises an imbedded reinforcing element or insert 10, illustrated for the sake of clarity only schematically and in top view (thus at 90° to its actual position), consisting of a flat bundle of reinforcing rods 1, 2, 3, 4, 5 with relatively staggered extremities that are disposed in the tension zone of member 9.

The lateral reinforcing rods 2 to 5 are reduced in length relatively to the central or main rod 1, according to the moments M decreasing toward the supports 11, so that reinforcement steel is saved. The ancillary rods 2 to 5 each contact at least one longer adjoining rod 1 to 4 over their entire length. In order to dispense with end-anchoring means, the forces acting upon the shorter reinforcing rods 2 to 5 are transferred in each instance to the next-longer reinforcing rod 1 to 4.

For the force transfer, segments 6 (FIG. 3) of two juxtaposed rods 1 to 5 are welded to each other. The overall cross-sectional areas of the elongate weld joints 7 between two reinforcing rods have a magnitude at least sufficient for the complete force transfer so that the tensile force is reduced to zero at the end of each shorter reinforcing rod 2 to 5, such a weld joint 7 existing at each of these ends. The overall cross-sectional areas of the connections between two reinforcing rods can, for example, be proportional to the cross-sectional areas of the shorter rod or rods 2 to 5 to be relieved of stresses.

If the insert 10 consists only of two reinforcing rods 1,2, the overall cross-sectional area of the joints 7 depends on the cross-sectional area of the shorter reinforcing rod 2. If, however, insert 10 consists of more than two reinforcing rods, the foregoing relationship applies only to the shortest one and to the end joints of the intermediate-length rods whereas in each intermediate segment of the longer reinforcing rods the overall cross-sectional areas of the joints correspond to the sum of the cross-sectional areas of all those shorter reinforcing rods from which the continuous force transfer to the longer reinforcing rod occurs.

Figure 2:
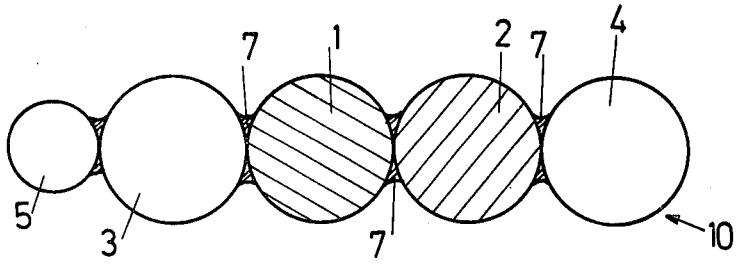
FIG. 2 is an enlarged cross-sectional view of the reinforcing element taken on line II—II of FIGS. 1 and 3.
Figure 3:
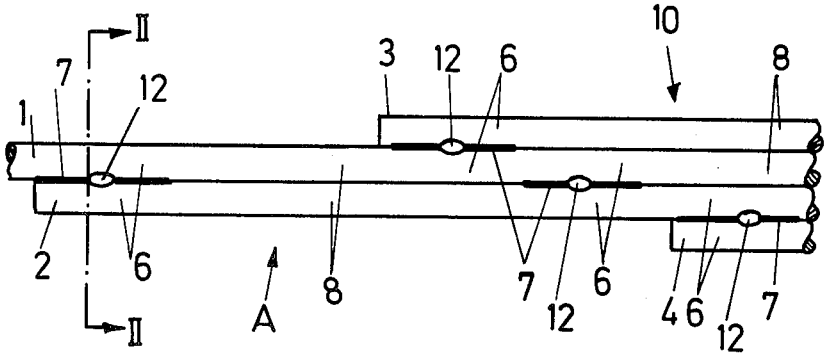
FIG. 3 shows details of the left-hand part A of the reinforcing element illustrated in FIG. 1.

This relationship will be further explained with reference to the example of FIGS. 2 and 3. In FIG. 3 (segment A from FIG. 1) where the extremities of three reinforcing rods 2, 3, 4 as well as the longest reinforcing rod 1 extending beyond them have been illustrated, connected segments 6 of identical length alternate with unconnected segments 8 which may also be all of the same length. The overall cross-sectional area of the connecting stretches formed by the weld joints 7 between the outermost reinforcing rods 3, 4 and the inner reinforcing rods 1, 2, respectively, depends on the cross-sectional areas of the reinforcing rods 3, 4, respectively, whereas the joints 7 between the two inner reinforcing rods 1, 2 in the region overlain by the outer, shorter reinforcing rod 4 must be suitably shaped for the transfer of the forces not only from rod 2 but also from rod 4. The overall cross-sectional area of the intermediate joints 7 between the reinforcing rods 1, 2 depends therefore in this region on the sum of the cross-sectional areas of the two reinforcing rods 2 and 4 to be relieved of stresses, yet in the end joints they would have to correspond only to the cross-sectional area of the reinforcing rod 2. Since, however, an overdimensioning of the cross-sectional areas of the joints 7 does not entail any disadvantages, the cross-sectional areas of all these joints may be dimensioned equal and able to absorb the largest stress for the sake of simplified manufacture.

Figure 8:
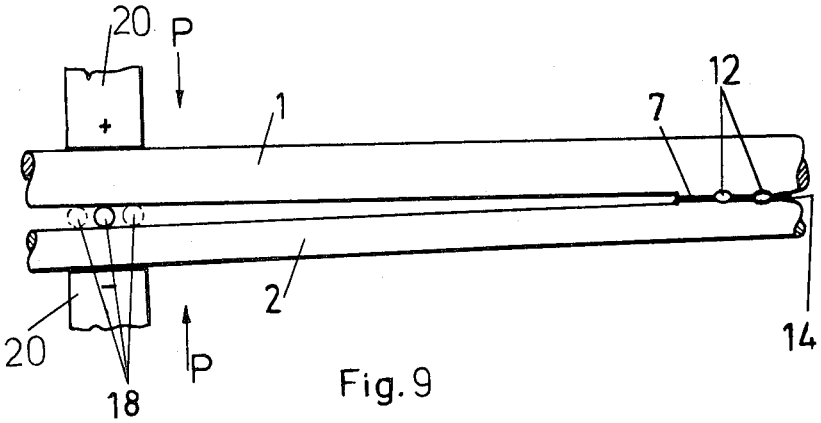
FIG. 8 is a top view of a reinforcing element according to FIG. 4*a* during manufacture with two weld points, one of them being represented before and the other after the welding process.
Figure 9:
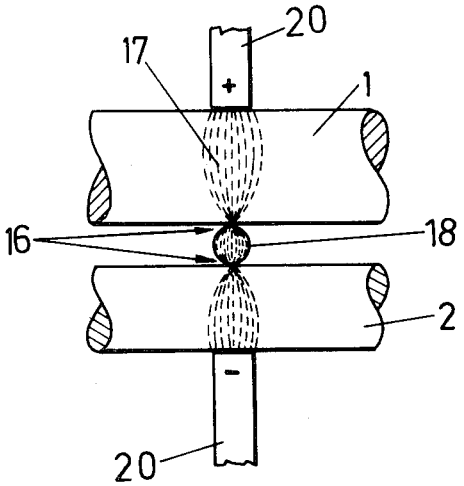
FIG. 9 is an enlarged view of a weld point at the instant of the welding process with illustrated current paths.
Figure 10:
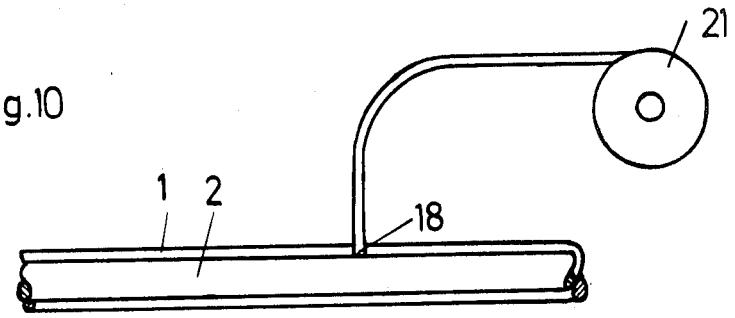
FIG. 10 is a side view of the assembly of FIG. 8 with schematic illustration of a feeding device for a welding wire.

The reinforcing rods 1 to 5 consist of bar steel especially of high tensile strength. The joints 7 of the reinforcing rods 1 to 5 are preferably realized by pressure/resistance welding. This has been schematically illustrated in FIGS. 8 to 10. For each welding plane two reinforcing rods 1, 2 of equal or different diameters are guided with mutual spacing between a pair of electrodes 20. The electrodes can be moved in the direction of the arrows P. According to FIG. 8 at least one fusible wire 18 is inserted between the reinforcing rods 1, 2 before the welding process, its diameter being less than that of the thinner reinforcing rod 2, preferably only about 0.4 to 0.5 times that. The wire 18 may be introduced in this embodiment between the reinforcing rods 1, 2 only so far that its end does not project to the other side. Preferentially, however, as can be gathered from FIG. 5 or 11, it can project to a certain extent beyond the reinforcing rods so that the projecting parts serve as spacers for a falsework 15, thus dispensing with the need for providing separate spacers, and/or as anchor studs 24 for improving the bonding in the concrete. During the welding process each wire 18 introduced between the reinforcing rods 1, 2 fuses to a weld bead 12 (FIGS. 3, 5, 8) which, under the electrode pressure, flows over a limited distance into the two gorges 14 formed upon contact between the rods by their confronting surfaces; after hardening, the wire material lodged in these gorges interconnects the two rods. In FIG. 9 the current flow has been schematically illustrated. A line contact exists between the electrodes 20 and the rods 1, 2. The schematically indicated current-flow lines extend substantially barrel-shaped in the reinforcing rods but are concentrated at each junction with wire 18 in a point 16. Since the resistance in the rods 1, 2 is relatively low in comparison with the resistance in wire 18, the rods 1, 2 are heated considerably less, i.e. the wire 18 is so highly heated that the weld bead 12 melts. This is furthermore accelerated by the high contact resistance at the points 16 so that the rods 1, 2 are softened only in the immediate vicinity of the points 16. Thus, the welded junction so produced influences the steel quality of the reinforcing rods 1, 2 to at most a slight and in any event negligible extent. It is also possible to introduce more than one wire 18 for each weld point if the force to be transferred exceeds the absorption capacity of one hardened weld bead, e.g. two further wires 18 substantially as shown dotted in FIG. 3. By this means it is also possible to make the force-transfer capacity different for individual joints 7 in that not all wires 18 are advanced in each working step and fused into weld beads 12. The right-hand joint in FIG. 8 shows, by way of example, only two weld beads 12. In this manner it is possible to achieve the aforementioned adaptation of the strength of the weld joints in reinforcing elements 10 in which larger tensile forces are to be transferred at the ends of the shorter rods than in the middle region. Each wire 18 can then be unwound, as shown in FIG. 10, from a reel 21.

Figure 4:
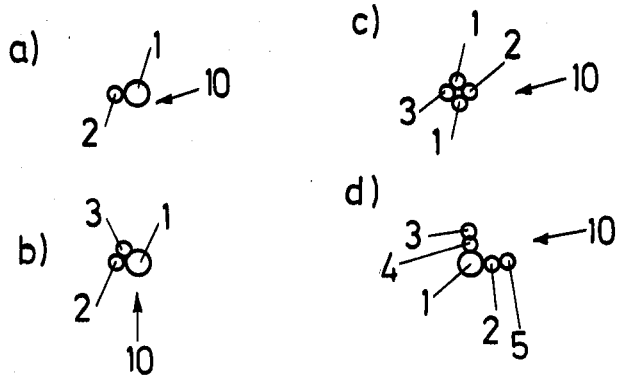
FIGS. 4*a* to 4*d* are end views of further reinforcing elements embodying my invention.

FIG. 4 shows further modifications of the reinforcing element 10 in front views. The one of FIG. 4*a* represents a two-rod insert wherein a heavier reinforcing rod 1 is combined with a thinner and shorter reinforcing rod 2. According to FIG. 4*b* a further reinforcing rod 3 has been attached. FIG. 4*c* shows a reinforcing element from four rods of equal thickness, wherein two longest rods 1 are connected with shorter rods 2 and 3, and in FIG. 4*d* five reinforcing rods 1 to 5 are disposed in an L-shaped assembly with the longest rod 1 having a larger diameter.

Figure 5:
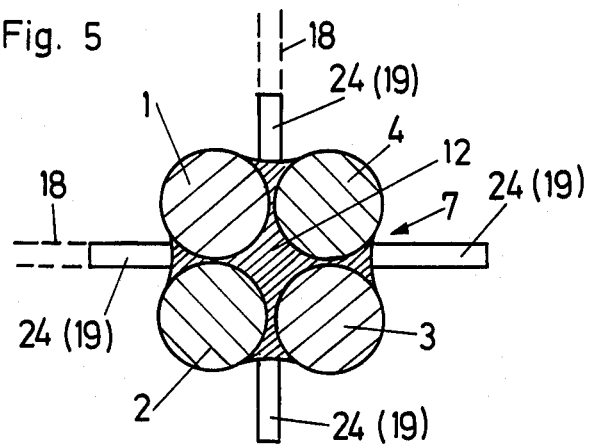
FIG. 5 is a cross-sectional view of yet a further embodiment.

In FIG. 5 there are shown four reinforcing rods 1, 2, 3, 4 and two intersecting wires 18 which are fused during the welding process into weld beads 12. The wires 18 may project in this case on all four sides beyond the reinforcing rods, the projecting parts being able to form spacers 19 or anchor studs 24.

Figure 6:
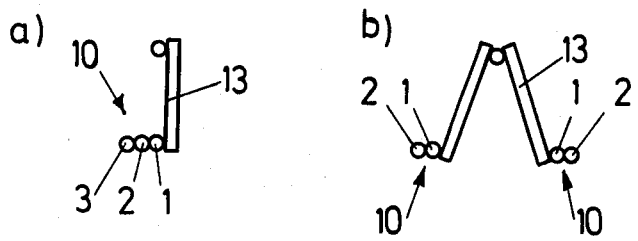
FIGS. 6*a* and 6*b* are end views of three-dimensional lattice girders with one (FIG. 6*a*) and with two (FIG. 6*b*) reinforcing elements according to the invention.
Figure 7:
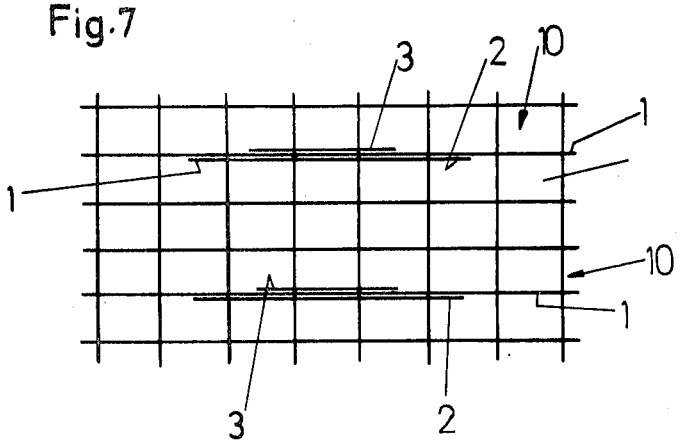
FIG. 7 is a top view of a reinforcing mat with two reinforcing elements according to the invention.
Figure 11:
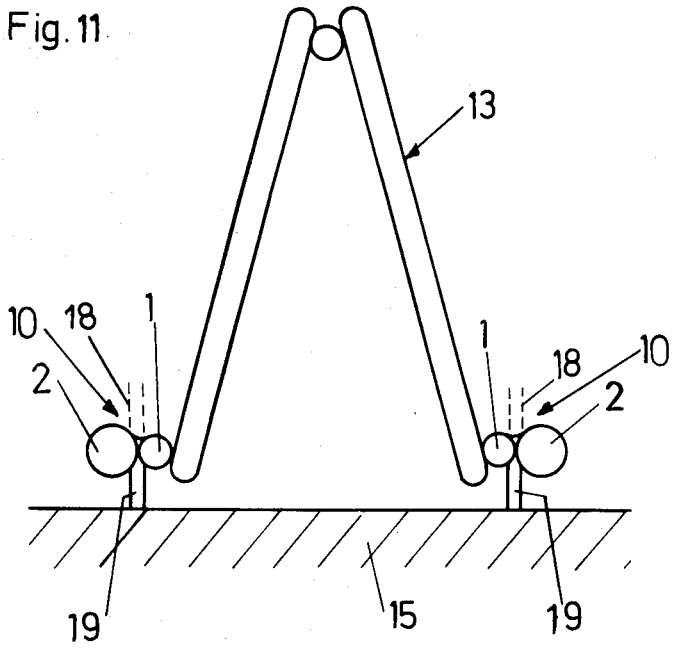
FIG. 11 is an enlarged representation of the lattice girder of FIG. 6*b* with spacers abutting an associated falsework.

FIGS. 6, 7, 11 show further instances of utilization of a reinforcing element 10 according to my invention. In FIGS. 6*a* and 6*b* there are shown three-dimensional reinforcing configurations 13, e.g. lattice girders, with a lower flange formed in FIG. 6*a* by a single three-rod assembly and in FIG. 6*b* by a two-rod assembly 10. As a particular advantage it will be noted that each ancillary rod 2, 3 can terminate at locations determined by the curvature of the moment line (cf. FIG. 1) and is not tied to the stirrups of the lattice girder since all forces have already been transferred out at its ends.

The embodiment of FIG. 6*b* is shown enlarged in FIG. 11. Here, reinforcing elements 10 according to the invention have been inserted in a lattice girder 13 in which they form the lower-flange reinforcements. As already discussed, the projecting parts of wire 18 not fused into weld beads form spacers 19 abutting the falsework 15.

A further example of inserts according to my invention, whose reinforcing rods are sized in approximation of a moment line, is shown in FIG. 7 where a reinforcing mat has been illustrated in which two throughgoing longitudinal rods 1 have been supplemented by shorter ancillary rods 2 and 3. From this view it becomes particularly clear that not every shorter reinforcing rod 2, 3 need terminate at a cross-rod of the mat.

Preferably, the longest or main reinforcing rod 1 is disposed at least approximately centrally in a group of ancillary rods (FIGS. 1 to 3, 4*d* and 7).

The introduction of wires 18 between the reinforcing rods and their fusion into weld beads 12 with simultaneous approach of the reinforcing rods 1, 2 by the contact pressure of the electrodes 20, pursuant to the process aspects of my invention, can be particularly easily and rationally accomplished in an automatic manufacturing plant. The severing of each wire 18, if it projects at most on one side, occurs in simple manner by the advance of the reinforcing element through the manufacturing plant since the wire 18 immobilized in the transport direction is detached thereby from the hardening weld bead 12. If inserts according to the invention are incorporated in reinforcing mats or lattice girders as shown in FIGS. 6, 7 and 11, this is advantageously done in such a way that ancillary reinforcing rods 2, 3 are brought on parallel and are fastened to a longitudinal main reinforcing rod 1 of the mat or girder already welded. For this purpose an additional electrode pair as well as a feeder for each wire 18 is disposed substantially at the end of the manufacturing plant. For the adaptation to the moment line there is further provided a specific transport device as well as a cutting device for each rod 2, 3 which can be controlled according to existing requirements.

I claim:

1. A reinforcing insert to be embedded in a tension zone of a ferroconcrete member, comprising an assembly of parallel, closely juxtaposed steel rods including at least one through-going main rod and at least one ancillary rod of lesser length adjoining same, said ancillary rod being connected with said main rod along a plurality of elongate stretches, two of said stretches being located at the ends of said ancillary rod which are offset from the extremities of said main rod to an extent letting the tensile strength of said assembly vary in approximate conformity with the moment line of said ferroconcrete member, said stretches having cross-sectional areas of sufficient strength to transfer the tensile stress of said ancillary rod from the ends thereof to said main rod.

2. A reinforcing insert as defined in claim 1 wherein said ancillary rod is part of a group of rods of different lengths all less than that of said main rod, the ends of each shorter rod being connected along two of said elongate stretches with an adjoining longer rod of said assembly.

3. A reinforcing insert as defined in claim 2 wherein said main rod is disposed substantially in the center of said group.

4. A reinforcing insert as defined in claim 1, 2 or 3 wherein said elongate stretches are weld joints.

5. A reinforcing insert as defined in claim 4 wherein a stud of welding wire projects transversely from at least one of said weld joints from between the rods interconnected thereby.

6. A reinforcing insert as defined in claim 5 wherein said welding wire has a diameter less than that of any of said rods.

7. A reinforcing insert as defined in claim 5 wherein said welding wire consists of a noncorroding material.

8. A reinforcing insert as defined in claim 1 or 2 wherein said stretches are of substantially identical length and alternate with unconnected rod segments also substantially equaling one another in length.

9. A process for making a reinforcing insert to be embedded in a tension zone of a ferroconcrete member, comprising the steps of:

(a) closely juxtaposing a plurality of steel rods of different lengths to form a parallel-rod assembly with the ends of said rods relatively staggered to an extent letting the tensile strength of said assembly vary in approximate conformity with the moment line of said ferroconcrete member; and (b) welding each shorter rod of said assembly at least at its ends to an adjoining longer rod along elongate stretches dimensioned to form weld joints of sufficient strength to transfer the tensile stress of said shorter rod to the adjoining longer rod.

10. A process as defined in claim 9 wherein step (b) is performed by inserting a fusible resistance wire between a pair of said rods to be interconnected, clamping said pair of rods between two electrodes, and moving said electrodes toward each other while passing a heating current therethrough with resulting compression of said wire between said rods and fusion thereof into a bead from which the wire material is allowed to flow prior to hardening over a limited distance in opposite directions along gorges defined by the confronting rod surfaces.

11. A process as defined in claim 10 wherein a part of said wire projecting from between said rods is left standing after fusion and hardening of said material.

* * * * *